US008952254B2

(12) United States Patent
Yu et al.

(10) Patent No.: US 8,952,254 B2
(45) Date of Patent: Feb. 10, 2015

(54) ELECTRONIC DEVICE COVER

(71) Applicants: Hong Fu Jin Precision Industry (ShenZhen) Co., Ltd., Shenzhen (CN); Hon Hai Precision Industry Co., Ltd., New Taipei (TW)

(72) Inventors: Zhan-Ao Yu, Shenzhen (CN); Quan Liao, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 87 days.

(21) Appl. No.: 13/893,336

(22) Filed: May 13, 2013

(65) Prior Publication Data

US 2014/0001087 A1 Jan. 2, 2014

(30) Foreign Application Priority Data

Jun. 27, 2012 (CN) ..... 2012 1 0214915

(51) Int. Cl.
*H02G 3/14* (2006.01)
*H05K 5/03* (2006.01)
*A45C 11/00* (2006.01)

(52) U.S. Cl.
CPC ..... *A45C 11/00* (2013.01); *A45C 2011/003* (2013.01)
USPC ..... 174/66; 361/679.3; 361/679.56; 206/45.2; 174/663

(58) Field of Classification Search
CPC ..... A45C 2011/003
USPC ..... 361/679.24, 679.55, 679.01, 679.3, 361/679.41, 679.56; 174/663, 66–67; 312/223.1; 206/588, 521.7, 591, 45.2
See application file for complete search history.

(56) References Cited

U.S. PATENT DOCUMENTS

| | | | | |
|---|---|---|---|---|
| 4,544,123 | A * | 10/1985 | Peacock | 248/460 |
| 5,887,723 | A * | 3/1999 | Myles et al. | 206/760 |
| 6,256,193 | B1 * | 7/2001 | Janik et al. | 361/679.59 |
| 6,353,531 | B1 * | 3/2002 | Howell et al. | 361/679.24 |
| 6,557,811 | B1 * | 5/2003 | Burns | 248/460 |
| 6,829,140 | B2 * | 12/2004 | Shimano et al. | 361/679.09 |
| 6,952,343 | B2 * | 10/2005 | Sato | 361/679.57 |
| 7,106,578 | B2 * | 9/2006 | Chen | 361/679.21 |
| RE39,429 | E * | 12/2006 | Hawkins et al. | 708/100 |
| 7,450,372 | B2 * | 11/2008 | Lin et al. | 361/679.55 |
| 7,633,760 | B2 * | 12/2009 | Wu et al. | 361/727 |
| 7,684,178 | B2 * | 3/2010 | Hsu et al. | 361/679.21 |
| 7,948,744 | B2 * | 5/2011 | Bishop et al. | 361/679.27 |

(Continued)

*Primary Examiner* — Adrian S Wilson
*Assistant Examiner* — Abhishek Rathod
(74) *Attorney, Agent, or Firm* — Novak Druce Connolly Bove + Quigg LLP

(57) ABSTRACT

An electronic device cover includes a base and a protection member. The base defines a positioning slot, a latch slot, and a through hole. The latch slot is in communication with the positioning slot, and the through hole is below the positioning slot. The protection member is configured to be secured to the base in a protection position and a stand position. When the protection member is in the protection position, the protection member is engaged in the latch slot, and a clipping space is defined between the protection member and the base, for receiving an electronic device. When the protection member is in the standing position, the protection member extends through the through hole to be engaged with the base, to support the base, and the positioning slot is configured to position the electronic device.

18 Claims, 5 Drawing Sheets

(56) References Cited

U.S. PATENT DOCUMENTS

| | | | | |
|---|---|---|---|---|
| 8,120,923 | B2 * | 2/2012 | Cheng | 361/727 |
| 8,161,908 | B2 * | 4/2012 | Cook et al. | 119/166 |
| 8,351,212 | B2 * | 1/2013 | Ku et al. | 361/752 |
| 8,359,078 | B2 * | 1/2013 | Hung | 455/575.8 |
| 8,416,568 | B2 * | 4/2013 | Tian et al. | 361/679.55 |
| 8,559,623 | B2 * | 10/2013 | Chen et al. | 379/433.12 |
| 8,644,893 | B2 * | 2/2014 | Liang | 455/575.1 |
| 8,724,300 | B2 * | 5/2014 | Smith et al. | 361/679.01 |
| 2004/0246666 | A1 * | 12/2004 | Maskatia et al. | 361/683 |
| 2005/0162824 | A1 * | 7/2005 | Thompson | 361/686 |
| 2005/0231930 | A1 * | 10/2005 | Jao | 361/807 |
| 2006/0061950 | A1 * | 3/2006 | Richardson et al. | 361/683 |
| 2007/0097087 | A1 * | 5/2007 | Homer et al. | 345/173 |
| 2010/0001163 | A1 * | 1/2010 | Takizawa | 248/371 |
| 2010/0084306 | A1 * | 4/2010 | Chiang | 206/523 |
| 2010/0101975 | A1 * | 4/2010 | Zhang et al. | 206/701 |
| 2011/0135133 | A1 * | 6/2011 | Choi et al. | 381/333 |
| 2011/0199727 | A1 * | 8/2011 | Probst | 361/679.09 |
| 2011/0259664 | A1 * | 10/2011 | Freeman | 181/202 |
| 2012/0008269 | A1 * | 1/2012 | Gengler | 361/679.09 |
| 2012/0012483 | A1 * | 1/2012 | Fan | 206/320 |
| 2012/0024741 | A1 * | 2/2012 | Beatty et al. | 206/521 |
| 2012/0170212 | A1 * | 7/2012 | Gallouzi et al. | 361/679.56 |
| 2012/0243149 | A1 * | 9/2012 | Gartrell et al. | 361/679.01 |
| 2013/0075285 | A1 * | 3/2013 | Peng et al. | 206/216 |
| 2013/0127308 | A1 * | 5/2013 | Yang | 312/223.1 |
| 2013/0299498 | A1 * | 11/2013 | Magness et al. | 220/315 |

* cited by examiner

ELECTRONIC DEVICE COVER

BACKGROUND

1. Technical Field

The present disclosure relates to electronic device covers, and particularly an all-in-one computer cover.

2. Description of Related Art

Electronic devices, such as all-in-one computers, include screens. Each all-in-one computer is received in a cover to protect the screen from being scratched. The cover may be made from leather and include a first panel and a second panel. The first panel is secured to a rear panel of the all-in-one computer by a latching structure. The second panel covers the screen. When the all-in-one computer needs to be positioned on a table, an additional bracket is needed to support the tablet with the cover. Thus, each all-in-one computer needs a cover plus an additional bracket, which makes the all-in-one computer expensive and inconvenient in carry. Furthermore, it is difficult to remove the all-in-one computer from the cover, and the all-in-one computer enclosure may also be scratched by the latching structure when the all-in-one computer is removed from the cover. Therefore, an improved electronic device cover may be desired.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
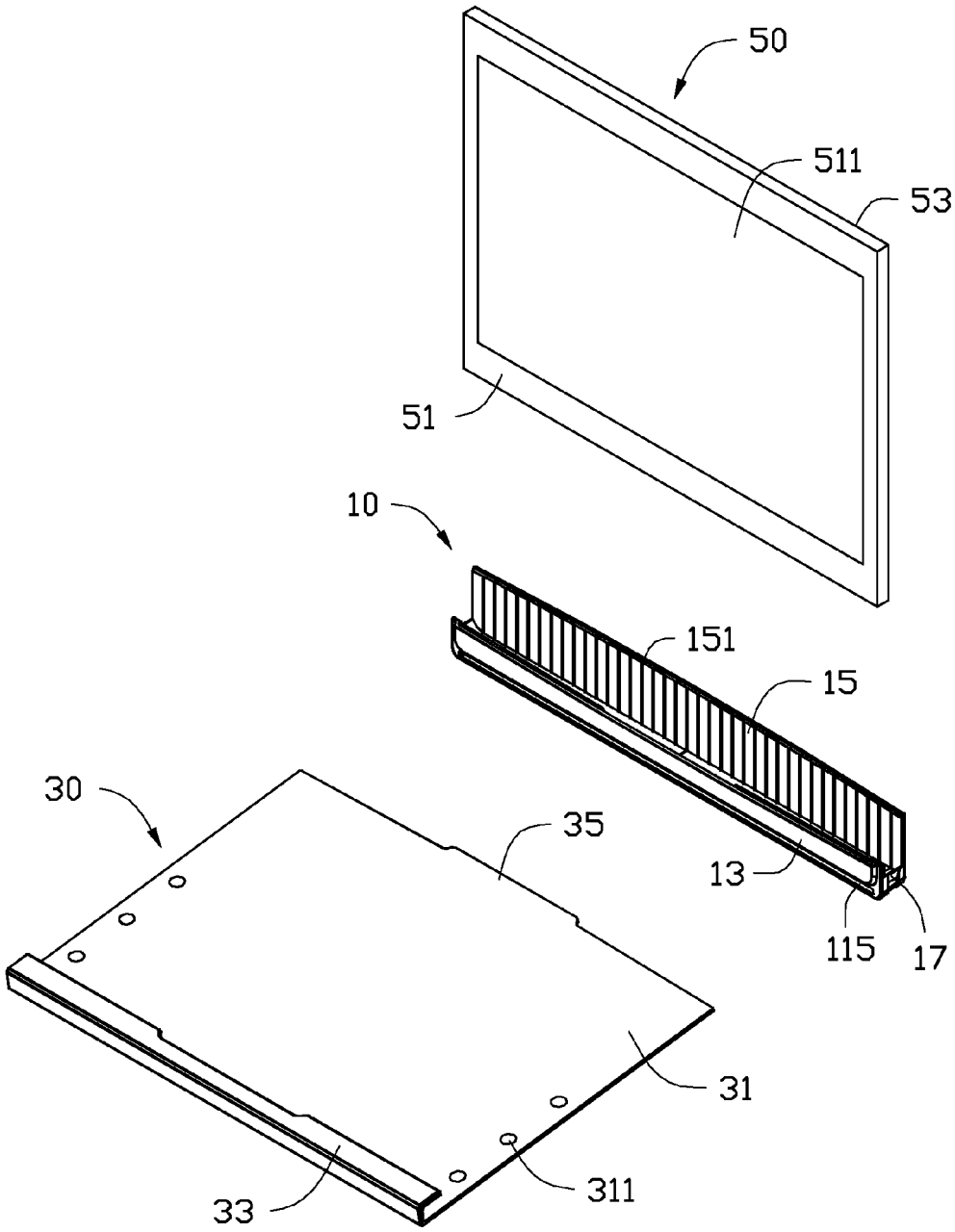
FIG. 1 is an exploded, isometric view of one embodiment of an electronic device cover and an electronic device.

FIG. 1 shows an electronic device cover in accordance with an embodiment for protection an electronic device 50. The electronic device cover includes a base 10 and a protection member 30.

The electronic device 50 includes a front panel 51, a rear panel 53 opposite to the front panel 51, and a screen 511 secured to the front panel 101. In one embodiment, the front panel 51 is substantially parallel to the rear panel 53. The electronic device 50 may be an all-in-one computer, or a signal display, or a television, for example.

The base 10 includes a bottom portion 11, a blocking plate 13, a supporting plate 15, and two stopping tabs 17. The bottom portion 11, the blocking plate 13, the supporting plate, and the two stopping tabs 17 cooperatively define an elongated positioning slot 19 for receiving the electronic device 50. The bottom portion 11 defines an elongated through hole 115 for the protection member 30 extending out of the base 10. The blocking plate 13 and the supporting plate 15 extend upwards from two opposite sides of the bottom portion 11. In one embodiment, the blocking plate 13 is substantially parallel to the supporting plate 15, and a first acute angle is defined between a first extension direction of the through hole 115 and a second extension direction of the positioning slot 19. A latch slot 131, for receiving the protection member 30, is defined an inner side of the blocking plate 13. A plurality of strips 151 are located an inner surface of the supporting plate 15, for engaging with the protection member 30.

The protection member 30 includes a protection plate 31 and a latch portion 33 extending from the protection plate 31. A size of the protection plate 31 is substantially equal to the size of the screen 511. A plurality of protrusions 311 are located on opposite sides of an inner surface of the protection plate 31, and a plurality of patterns 313 are designed on outer surface of the protection plate 31. In one embodiment, the plurality of protrusions 311 is made of plastic.

The latch portion 33 includes a clipping plate 331 and a resilient plate 333 extend from the clipping plate 331. The clipping plate 331 extends from one edge of the protection plate 31, and an insertion tab 35 extends from another edge of the protection plate 31. In one embodiment, the clipping plate 331 is substantially perpendicular to the protection plate 31, the resilient plate 333 is substantially perpendicular to the clipping plate 331 and parallel to the protection plate 31. A plurality of gaskets 3331 is located on an inner surface of the resilient plate 333.

Figure 2:
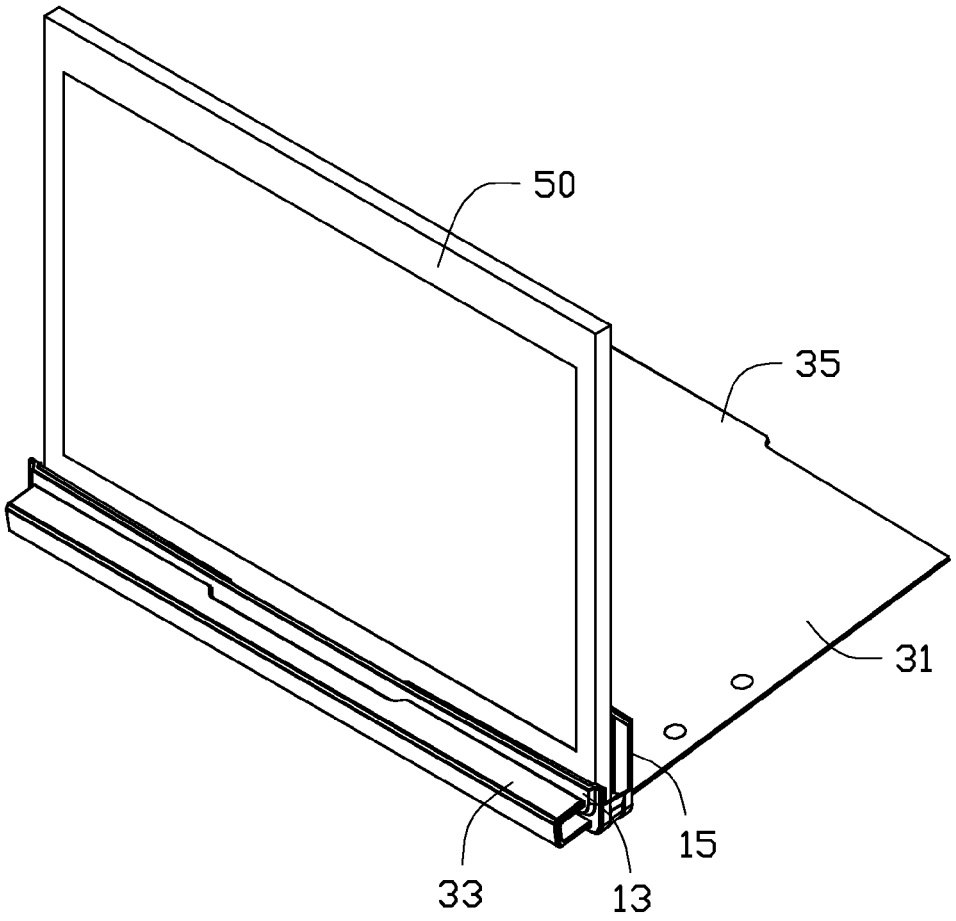
FIG. 2 is an assembled, isometric view of the electronic device cover and the electronic device of FIG. 1, and a protection member is located in a stand position.
Figure 3:
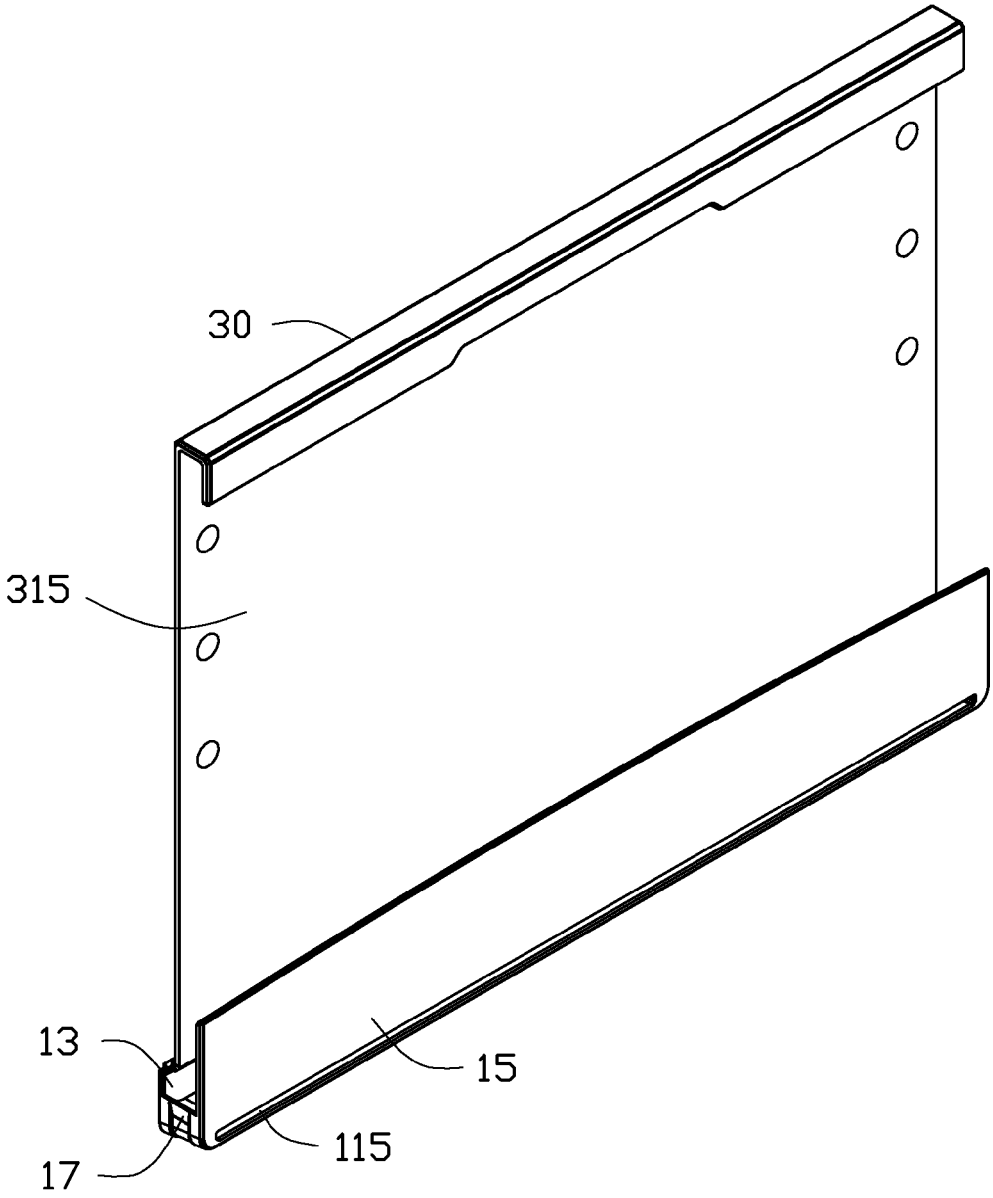
FIG. 3 is a partially assembled, isometric view of the electronic device cover of FIG. 1, and the protection member is located in a protection position.
Figure 4:
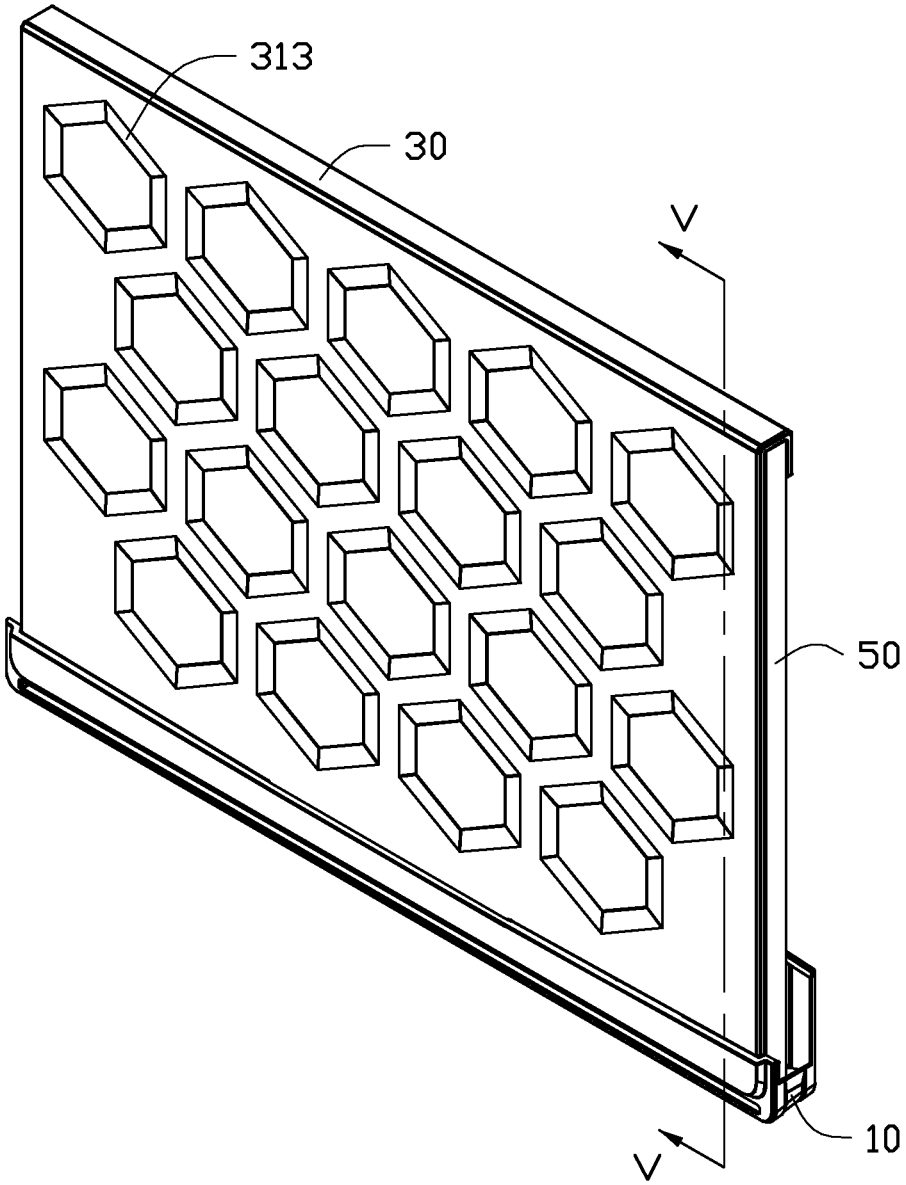
FIG. 4 is an assembled, isometric view of the electronic device cover and the electronic device of FIG. 1, and the support member is located in a protection position.
Figure 5:
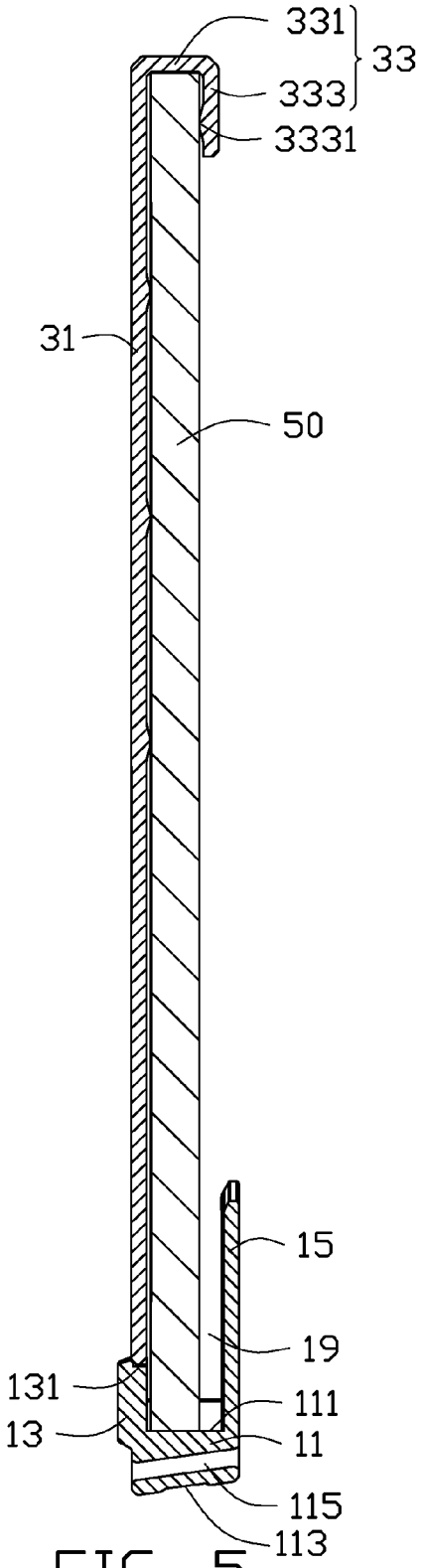
FIG. 5 is a cross-sectional view of the electronic device of FIG. 4, taken along the line V-V.

FIGS. 2-4 show that, in use, the insertion tab 35 is inserted into the through hole 115 from the front side of the base 10, to extend the protection plate 31 out of the back side of base 10, until the latch portion 33 is engaged with the base 10. The base 10 and the protection member 30 are placed on a plane, and a second acute angle is defined between the protection plate 31 and the supporting plate 15. Thus, the protection member 30 is located in a stand position to support the base 10.

When the electronic device 50 needs to be carried or stored, the insertion tab 35 is inserted into the latch slot 131, so that the protection member 30 and the base cooperatively define a clipping space 315 for receiving the electronic device 50. The protection plate 31 faces the first plane 111. One end of the electronic device 50 is accommodated in the positioning slot 19, and the resilient plate 333 is deformable to engage another end of the electronic device 50 between the latch portion 33 and the protection plate 31. The plurality of gaskets 3331 and the plurality of protrusions 311 abut the front panel 51 and the rear panel 53, respectively, and the protection plate 31 is substantially parallel to the supporting plate 15. The protection member 30 relative to the base 10 is thereby located in a protection position.

It is to be understood, however, that even though numerous characteristics and advantages have been set forth in the foregoing description of embodiments, together with details of the structures and functions of the embodiments, the disclosure is illustrative only and changes ay be made in detail, especially in the matters of shape, size, and arrangement of parts within the principles of the disclosure, to the full extent indicated by the broad general meaning of the terms in which the appended claims are expressed.

What is claimed is:

1. An electronic device cover for an electronic device comprising:

a base defining a positioning slot, a latch slot, and a through hole; and the latch slot being in communication with the positioning slot, and the through hole being below the positioning slot; and a protection member, wherein the protection member is secured to the base in a protection position or a stand position; when the protection member is in the protection position, the protection member is engaged in the latch slot, and a clipping space is defined between the protection member and the base, for receiving the electronic device; and when the protection member is in the stand position, the protection member extends through the through hole to engage with and support the base, and the positioning slot is configured to position the electronic device.

2. The electronic device cover of claim 1, wherein the through hole extends along a first extension direction, the positioning slot extends along a second extension direction, and an acute angle is defined between the first extension direction and the second extension direction.

3. The electronic device cover of claim 1, wherein the protection member comprises a protection plate and a latch portion, extending from the protection plate; when in the protection position, the latch portion is configured to engage with the electronic device, and an end of the protection plate opposite to the latch portion is engaged in the latch slot; and when in the stand position, the protection plate extends through the through hole, and the latch portion is engaged with the base.

4. The electronic device cover of claim 3, wherein an insertion tab extends from the protection plate, and the insertion tab is engaged in the latch slot when the protection member is located in the protection position.

5. The electronic device cover of claim 3, wherein the latch portion comprises a clipping plate and a resilient plate, the clipping plate extends from the protection plate to the resilient plate, the clipping plate is substantially perpendicular to the protection plate and the resilient plate, and the resilient plate is substantially parallel to the protection plate.

6. The electronic device cover of claim 5, wherein a plurality of gaskets are located on the resilient plate and configured to abut the electronic device.

7. The electronic device cover of claim 5, wherein the base comprises a bottom portion, a blocking plate, and a supporting plate; the blocking plate and the supporting plate extend from the bottom portion; and the positioning slot is surrounded by the bottom portion, the blocking plate and the supporting plate.

8. The electronic device cover of claim 7, wherein a plurality of strip cushions are located on the supporting plate, for securing the electronic device when in the stand position.

9. The electronic device cover of claim 7, wherein when in the protection position, the protection plate is substantially parallel to the supporting plate; and when in the stand position, an acute angle is defined between the protection plate and the supporting plate.

10. An electronic device cover comprising:

a base comprising a bottom portion, a supporting plate and a blocking plate, the bottom portion, the supporting plate and the blocking plate cooperatively defining a positioning slot, the blocking plate defining a latch slot communication with the positioning slot, the bottom portion defining a through hole below the positioning slot; and a protection member, wherein the protection member is configured to secured to the base in a protection position and a stand position; when the protection member is in the protection position, the protection member is engaged in the latch slot, and a clipping space is defined between the protection member and the base, for receiving an electronic device; when the protection member is in the stand position, the protection member extends through the through hole to be engaged with the base, to support the base, and the positioning slot is configured to position the electronic device.

11. The electronic device cover of claim 10, wherein the through hole has a first extension direction, the positioning slot has a second extension direction, and an acute angle is defined between the first extension direction and the second extension direction.

12. The electronic device cover of claim 10, wherein the protection member comprises a protection plate and a latch portion extending from the protection plate; when the protection member is in the protection position, the latch portion is configured to engage with the electronic device, and an end of the protection plate opposite to the latch portion is engaged in the latch slot and configured to cover the electronic device; when the protection member is in the stand position, the latch portion is engaged with the base, and the protection plate extends through the through hole, to support the base.

13. The electronic device cover of claim 12, wherein an insertion tab extends from the protection plate, and the insertion tab is engaged in the latch slot when the protection member is located in the protection position.

14. The electronic device cover of claim 12, wherein the latch portion comprises a clipping plate and a resilient plate, the clipping plate extends from the protection plate to the resilient plate, the clipping plate is substantially perpendicular to the protection plate and the resilient plate, and the resilient plate is substantially parallel to the protection plate.

15. The electronic device cover of claim 14, wherein a plurality of gaskets are located on the resilient plate and configured to abut the electronic device.

16. The electronic device cover of claim 14, wherein the base further comprises two stopping tabs, and the two stopping tabs are connected to the blocking plate and the supporting plate.

17. The electronic device cover of claim 12, wherein when the protection member is in the protection position, the protection plate is substantially parallel to the supporting plate; when the protection member is in the stand position, an acute angle is defined between the protection plate and the supporting plate.

18. The electronic device cover of claim 10, wherein a plurality of strips are located on the supporting plate, for supporting the electronic device when the protection member is in the stand position.

* * * * *